US011811171B2

(12) United States Patent
Champion et al.

(10) Patent No.: US 11,811,171 B2
(45) Date of Patent: Nov. 7, 2023

(54) CABLE TERMINATION FOR AN ELECTRICAL CONNECTOR

(71) Applicant: TE Connectivity Solutions GmbH, Schaffhausen (CH)

(72) Inventors: Bruce Allen Champion, Camp Hill, PA (US); Jeffrey Stewart Simpson, Mechanicsburg, PA (US); Chad William Morgan, Carneys Point, NJ (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 44 days.

(21) Appl. No.: 17/694,743

(22) Filed: Mar. 15, 2022

(65) Prior Publication Data

US 2023/0299544 A1 Sep. 21, 2023

(51) Int. Cl.
*H01R 13/6592* (2011.01)
*H01R 12/71* (2011.01)
*H01R 12/70* (2011.01)

(52) U.S. Cl.
CPC ..... *H01R 13/6592* (2013.01); *H01R 12/707* (2013.01); *H01R 12/718* (2013.01)

(58) Field of Classification Search
CPC . H01R 13/6592; H01R 12/707; H01R 12/718
See application file for complete search history.

(56) References Cited

U.S. PATENT DOCUMENTS

| | | | | |
|---|---|---|---|---|
| 8,840,432 | B2 | 9/2014 | Alden, III et al. | |
| 9,124,009 | B2 | 9/2015 | Atkinson et al. | |
| 9,203,193 | B2 | 12/2015 | Hackman et al. | |
| 9,437,949 | B2 | 9/2016 | Behziz et al. | |
| 9,490,588 | B2 * | 11/2016 | Keyser | H01R 12/53 |
| 10,170,862 | B2 | 1/2019 | Weidner et al. | |
| 10,411,374 | B2 | 9/2019 | Tanaka et al. | |
| 11,189,943 | B2 | 11/2021 | Zerebilov et al. | |
| 2006/0234556 | A1 * | 10/2006 | Wu | H01R 12/721 439/607.05 |
| 2019/0280435 | A1 * | 9/2019 | Henry | H01R 13/424 |

* cited by examiner

*Primary Examiner* — Travis S Chambers

(57) ABSTRACT

A cable card assembly includes a circuit card and cables terminated to the circuit card. Each cable has signal conductors, an insulator, and a cable shield. The cable card includes conductor holders forward of the insulators manufactured from a dielectric material and having conductor channels that receive the signal conductors. The cable card assembly includes ground shields coupled to the circuit card providing electrical shielding for the cables. Each ground shield includes a side walls and an end wall. The end wall has an end wall connecting portion coupled to the cable shield. The first side wall has a first side wall connecting portion coupled to the cable shield. The second side wall has a second side wall connecting portion coupled to the cable shield.

20 Claims, 6 Drawing Sheets

CABLE TERMINATION FOR AN ELECTRICAL CONNECTOR

BACKGROUND OF THE INVENTION

The subject matter herein relates generally to electrical connectors.

Electrical connectors are used to electrically connect components with an electrical system, such as a data communication system. For example, known electrical systems include plug connectors that are mated with receptacle connectors. Conventional plug connectors are provided at ends of cables, which are terminated to a circuit card of the plug connector. The circuit card is configured to be plugged into a card slot of the receptacle connector.

However, known plug connectors have problems with cross talk and return loss, particularly when transmitting high speed data signals. For example, signal degradation occurs at the interface between the cables and the circuit card. Signal degradation may occur because of a lack of shielding at the termination zone and due to stripping of the signal conductors from the insulator and transitioning the exposed conductors into air, which has a different dielectric constant compared to the dielectric of the cable insulator. Some known electrical connectors use hot melt epoxy or overmolding of the signal conductors. However, the hot melt epoxy or overmolding introduces heat to the cable, which may cause damage to the cable. Additionally, it is difficult to control the application of the hot melt epoxy or overmolding material, leading to inconsistency in the signal transmission paths. Furthermore, the hot melt epoxy or overmolding material is typically high loss material, leading to insufficient signaling through the electrical connector. The problems with known plug connectors are increased as data rates increase.

A need remains for improved performance for electrical connector at high data rates.

BRIEF DESCRIPTION OF THE INVENTION

In one embodiment, a cable card assembly is provided and includes a circuit card having a substrate including an upper surface and a lower surface. The substrate extending between a mating end and a cable end. The circuit card has mating pads at the mating end. The circuit card has cable pads at the cable end. The cable pads is electrically connected to corresponding mating pads. The circuit card has a ground plane. The cable card assembly includes cables terminated to the circuit card at the cable end. Each cable has signal conductors and an insulator surrounding the signal conductors. Terminating ends of the signal conductors exposed forward of an end of the insulator. The cable has a cable shield providing electrical shielding for the at least one signal conductor. The cable shield surrounding the insulator. The cable card includes conductor holders located forward of ends of the insulators. Each conductor holder is manufactured from a dielectric material. Each conductor holder has conductor channels that receive the terminating ends of the corresponding signal conductors. The cable card assembly includes ground shields terminated to the ground plane of the circuit card at the cable end. The ground shields providing electrical shielding for the corresponding cables. Each ground shield includes a first side wall, a second side wall and an end wall between the first and second side walls. The first and second side walls extending from the end wall to the circuit card. The end wall has an end wall connecting portion coupled to the cable shield. The first side wall has a first side wall connecting portion coupled to the cable shield. The second side wall has a second side wall connecting portion coupled to the cable shield.

In another embodiment, a cable assembly for a circuit card is provided. The cable assembly includes a cable having a first signal conductor, a second signal conductor, and an insulator surrounding the first and second signal conductors. The first and second signal conductors have terminating ends exposed forward of an end of the insulator. The terminating ends configured to be terminated to the circuit card. The cable includes a cable shield providing electrical shielding for the first and second signal conductors. The cable shield surrounding the insulator. The cable assembly includes a conductor holder located forward of the end of the insulator. The conductor holder is manufactured from a dielectric material. The conductor holder includes conductor channels that receive the terminating ends of the first and second signal conductors. The cable assembly includes a ground shield configured to be terminated to the circuit card. The ground shield providing electrical shielding for the terminating ends. The ground shield includes a first side wall, a second side wall and an end wall between the first and second side walls. The first and second side walls extending from the end wall. The end wall has an end wall connecting portion coupled to the cable shield. The first side wall has a first side wall connecting portion coupled to the cable shield. The second side wall has a second side wall connecting portion coupled to the cable shield.

In a further embodiment, an electrical connector is provided and includes a connector housing extending between a mating end and a cable end. The mating end configured to be coupled to a mating electrical connector. The connector housing has a housing cavity. The electrical connector includes a cable card assembly received in the housing cavity. The cable card assembly includes a circuit card and cables terminated to the circuit card. The cable card assembly includes conductor holders associated with the cables. The cable card assembly includes ground shields associated with the cables and terminated to the circuit card to provide electrical shielding for the cables. The circuit card includes a substrate including an upper surface and a lower surface. The substrate extending between a mating end and a cable end. The circuit card has mating pads at the mating end configured to be mated with the mating electrical connector. The circuit card has cable pads at the cable end. The cable pads are electrically connected to corresponding mating pads. The circuit card has a ground plane. The cables are terminated to the circuit card at the cable end. Each cable has signal conductors and an insulator surrounding the signal conductors. Terminating ends of the signal conductors are exposed forward of an end of the insulator. The cable has a cable shield providing electrical shielding for the at least one signal conductor. The cable shield surrounding the insulator. The conductor holders are located forward of the ends of the insulators. Each conductor holder is manufactured from a dielectric material. Each conductor holder has conductor channels that receive the terminating ends of the corresponding signal conductors. Ground shields are terminated to the ground plane of the circuit card at the cable end. The ground shields providing electrical shielding for the corresponding cables. Each ground shield includes a first side wall, a second side wall and an end wall between the first and second side walls. The first and second side walls extending from the end wall to the circuit card. The end wall has an end wall connecting portion coupled to the cable shield. The first side wall has a first side wall connecting portion coupled to the cable shield. The second side wall has a second side wall connecting portion coupled to the cable shield.

DETAILED DESCRIPTION OF THE INVENTION

Figure 1:
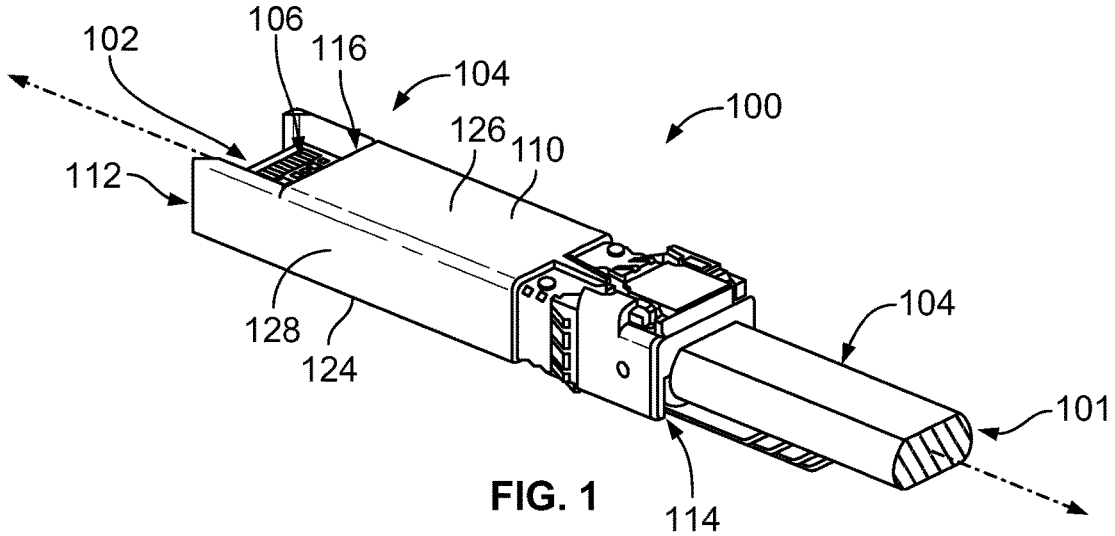
FIG. 1 is a bottom perspective view of an electrical connector in accordance with an exemplary embodiment.

FIG. 1 is a bottom perspective view an electrical connector 100 in accordance with an exemplary embodiment. In the illustrated embodiment, the electrical connector 100 is a pluggable module, such as a transceiver module or an I/O module, configured to be electrically connected to a mating electrical connector (not shown), such as a receptacle connector. In an exemplary embodiment, the electrical connector 100 is a cable connector provided at ends of cable assemblies 101.

The electrical connector 100 includes a cable card assembly 102. The cable card assembly 102 includes the cable assemblies 101 and a circuit card 106. Each cable assembly 101 includes a cable 104 terminated to the circuit card 106. Each cable assembly 101 includes features used to improve electrical performance of the cable assembly 101, such as to provide electrical shielding, impedance control, and other features that mitigate loss or signal degradation. In an exemplary embodiment, the cable assembly 101 includes a ground shield 200 (shown in FIG. 2) and a conductor holder 300. The conductor holder 300 positions the conductors of the cables 104 relative to each other and relative to the circuit card 106. The conductor holder 300 controls impedance by controlling the dielectric surrounding the conductors of the cables 104 in the termination zone to improve electrical performance of the cable card assembly 102. The ground shield 200 provides electrical shielding around the conductors at the termination zone with the circuit card 106. The ground shield 200 is electrically connected to the cable shield of the cable 104 and the circuit card 106 to control the ground return paths. The ground shield 200 controls electromagnetic fields in the termination zone to reduce insertion loss and cross talk to improve electrical performance of the cable card assembly 102.

The circuit card 106 provides an interface between the cables 104 and the mating electrical connector. For example, an edge of the circuit card 106 may be plugged into a card slot of the mating electrical connector. In an exemplary embodiment, the electrical connector 100 includes a connector housing 110 that receives the cable card assembly 102. However, in alternative embodiments, the electrical connector 100 may be provided without the connector housing 110. The connector housing 110 extends between a mating end 112 and a cable end 114. The cables 104 extend from the cable end 114. The mating end 112 is configured to be mated with the mating electrical connector.

In an exemplary embodiment, the connector housing 110 forms a cavity 116 that receives the circuit card 106. The connector housing 110 positions the circuit card 106 in the cavity 116 for mating with the mating electrical connector. In various embodiments, the end of the circuit card 106 may extend out of the cavity 116 and protrude forward of the connector housing 110.

In various embodiments, the connector housing 110 may be a multipiece housing. For example, the connector housing 110 may include an upper shell and a lower shell coupled to the upper shell. The cavity 116 is formed between the upper shell and the lower shell. In the illustrated embodiment, the upper shell forms a top 124 of the connector housing 110 and the lower shell forms a bottom 126 of the connector housing 110. The upper shell and/or the lower shell may form sides 128 of the connector housing 110. In various embodiments, the upper shell and the lower shell are manufactured from a conductive material, such as a metal material. Optionally, the upper and lower shells may be diecast. The upper and lower shells provide electrical shielding for the cable card assembly 102. In an exemplary embodiment, the upper and lower shells may be thermally conductive to dissipate heat from the cable card assembly 102. The connector housing 110 may be a single piece housing in alternative embodiments rather than having upper and lower shells.

Other types of connector housings 110 may be provided in alternative embodiments. For example, the connector housing 110 may be a plastic housing. In various embodiments, the connector housing 110 includes latching features for securing the electrical connector 100 to the mating electrical connector. Optionally, the connector housing 110 may include keying features to guide mating of the electrical connector 100 with the mating electrical connector.

Figure 2:
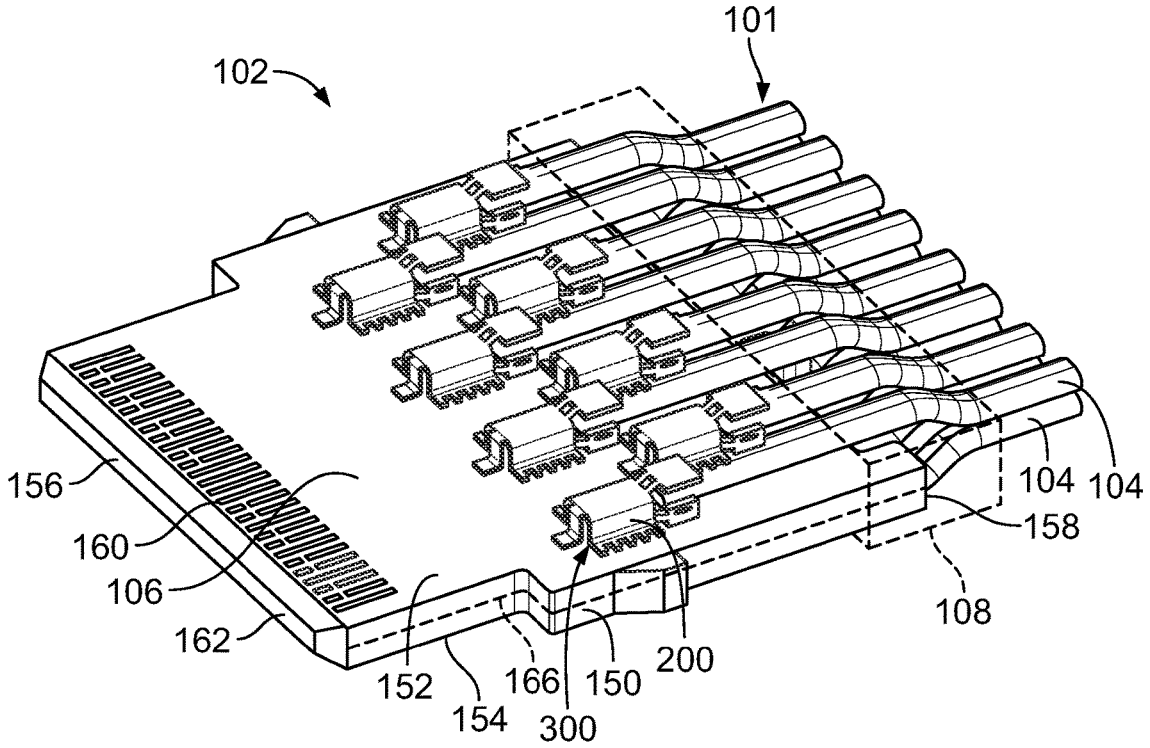
FIG. 2 is a top view of the cable card assembly in accordance with an exemplary embodiment.
Figure 3:
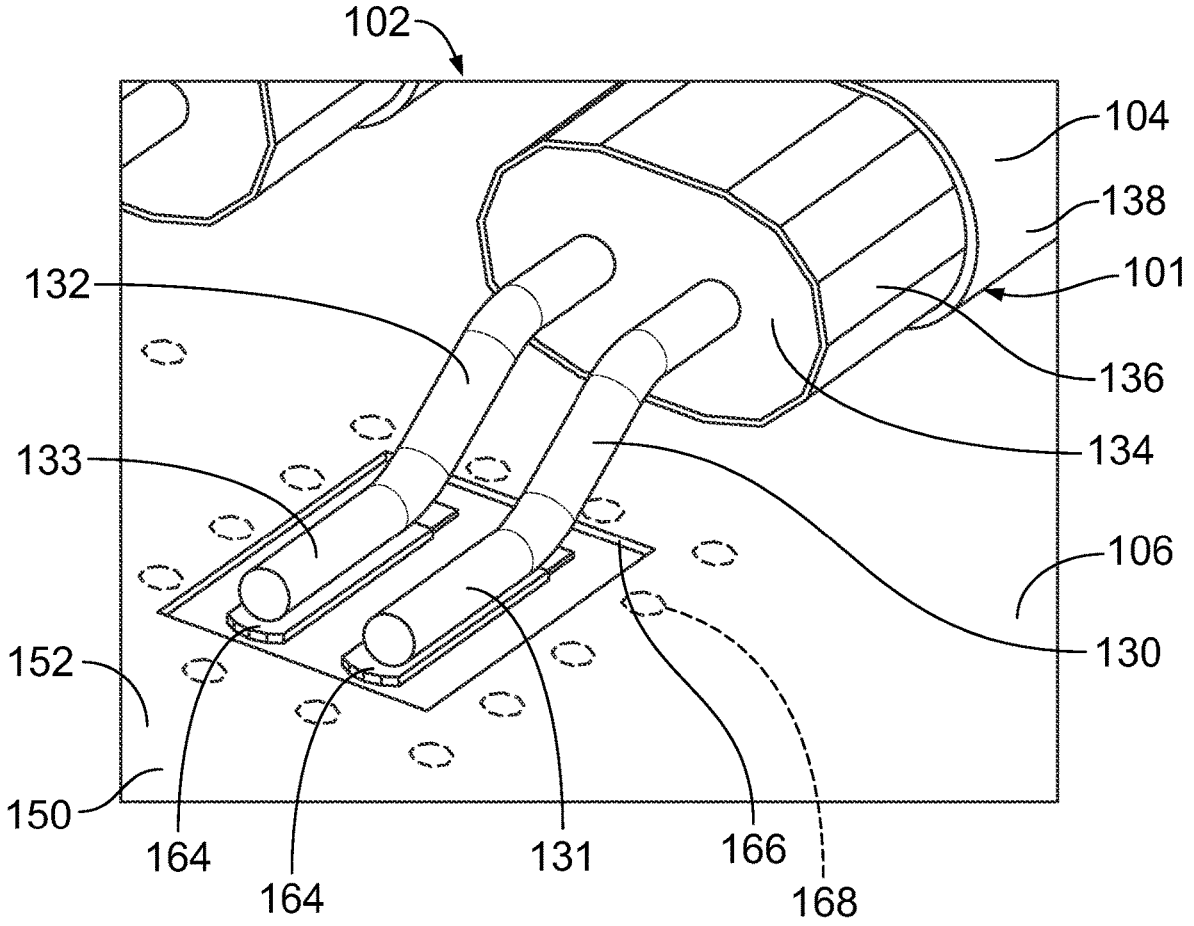
FIG. 3 is a perspective view of a portion of the cable card assembly showing a portion of one of the cable assemblies in accordance with an exemplary embodiment.

FIG. 2 is a top view of the cable card assembly 102 in accordance with an exemplary embodiment. FIG. 3 is a perspective view of a portion of the cable card assembly 102 showing a portion of one of the cable assemblies 101. The cable card assembly 102 includes the circuit card 106 and the cable assemblies 101. The cables 104 of the cable assemblies 101 are terminated to the circuit card 106. FIG. 3 shows one of the cables 104 terminated to the circuit card 106 with the ground shield 200 and conductor holder 300 removed for clarity to illustrate features of the cable 104.

In an exemplary embodiment, the circuit card assembly 102 includes a strain relief member 108 (shown in phantom in FIG. 2). The strain relief member 108 is coupled to the cables 104. The strain relief member 108 may be coupled to the circuit card 106. The strain relief member 108 may be an overmold that is formed in place over the cables 104 to secure the cables 104 to each other and/or to the circuit card 106.

The cables 104 are high speed signal cables. In an exemplary embodiment, the cables 104 are twin axial cables each having a pair of signal conductors. However, in alternative embodiments, the cables 104 may be coaxial cables having a single signal conductor or other types of cables. With reference to FIG. 3, in the illustrated embodiment, each cable 104 includes a first signal conductor 130 and a second signal conductor 132. The signal conductors 130, 132 transmit differential signals and form a differential pair. The signal conductors 130, 132 are held by an insulator 134 within a bore of the cable 104. A cable shield 136 surrounds the insulator 134. The cable shield 136 may be a foil or tape wrapped around the insulator 134, such as an aluminum foil. The cable shield 136 provides electrical shielding for the signal conductors 130, 132 along the length of the cable 104. A cable jacket 138 surrounds the cable shield 136.

During assembly, the end of the cable 104 is prepared by removing a portion of the cable jacket 138 to expose the cable shield 136 along a length at the end of the cable. A portion of the cable shield 136 and the insulator 134 are removed to expose terminating ends 131, 133 of the signal conductors 130, 132. The terminating ends 131, 133 of the signal conductors 130, 132 are configured to be soldered to the circuit card 106. The conductor holders 300 are used to hold and position the terminating ends 131, 133 of the signal conductors 130, 132. The conductor holders 300 are located immediately forward of the end of the insulators 134. The conductor holders 300 provide dielectric material around the terminating ends 131, 133. In an exemplary embodiment, the ground shield 200 is used to electrically connect the cable shield 136 to the circuit card 106. The ground shield 200 may provide a mechanical and electrical connection between the cable 104 and the circuit card 106. The ground shield 200 provides electrical shielding for the terminating ends 131, 133 of the signal conductors 130, 132 to reduce crosstalk between adjacent cables 104. The ground shield 200 may surround and connect to the cable shield 136 on multiple sides, such as on three sides, to provide nearly circumferential shielding, particularly in combination with the ground plane of the circuit card 106.

The circuit card 106 is a layered circuit board structure in an exemplary embodiment. The circuit card 106 includes a substrate 150, which may include multiple layers. The substrate 150 has an upper surface 152 and a lower surface 154. The substrate 150 extends between a first end or mating end 156 (for example, front portion) and a second end or cable end 158 (for example, rear portion) of the circuit card 106. The cables 104 are terminated to the circuit card 106 at the cable end 158 (for example, closer to the rear edge). The mating end 156 is configured to be mated with the mating electrical connector (for example, front edge is configured to be plugged into a card slot or bottom is configured to be plugged into a socket).

In an exemplary embodiment, the circuit card 106 includes mating pads 160 at the mating end 156. The mating pads 160 are circuits or conductors of the circuit card 106. The mating pads 160 are provided proximate to a mating edge 162 of the circuit card 106, which is configured to be plugged into a card slot of the mating electrical connector. Optionally, the mating pads 160 may be provided at the upper surface 152 and/or the lower surface 154. The mating pads 160 may be signal conductors and/or cable shields.

In an exemplary embodiment, the circuit card 106 includes cable pads 164 at the cable end 158. The cable pads 164 are circuits or conductors of the circuit card 106. The cable pads 164 are electrically connected to corresponding mating pads 160, such as through vias, traces, and other circuits of the circuit card 106. Optionally, the cable pads 164 may be provided at the upper surface 152 and/or the lower surface 154. The cable pads 164 may be provided in multiple rows staggered between the front and the rear of the circuit card 106. In an exemplary embodiment, the cable pads 164 are arranged in pairs. The terminating ends 131, 133 of the signal conductors 130, 132 of the cables 104 are terminated to corresponding cable pads 164, such as by soldering the signal conductors 130, 132 to the cable pads 164.

In an exemplary embodiment, the circuit card 106 includes one or more ground planes 166 at one or more layers of the substrate 150. For example, the ground planes 166 may be provided at the upper surface 152 and the lower surface 154. The ground planes 166 provide electrical shielding for the circuit card 106. In an exemplary embodiment, the ground shields 200 are terminated to the ground planes 166. For example, the ground shields 200 may be press-fit into ground vias 168 in the circuit card 106, which are electrically connected to the ground planes 166. The ground shield 200 may additionally, or alternatively, the soldered to the ground vias 168 and/or the ground plane 166.

Figure 4:
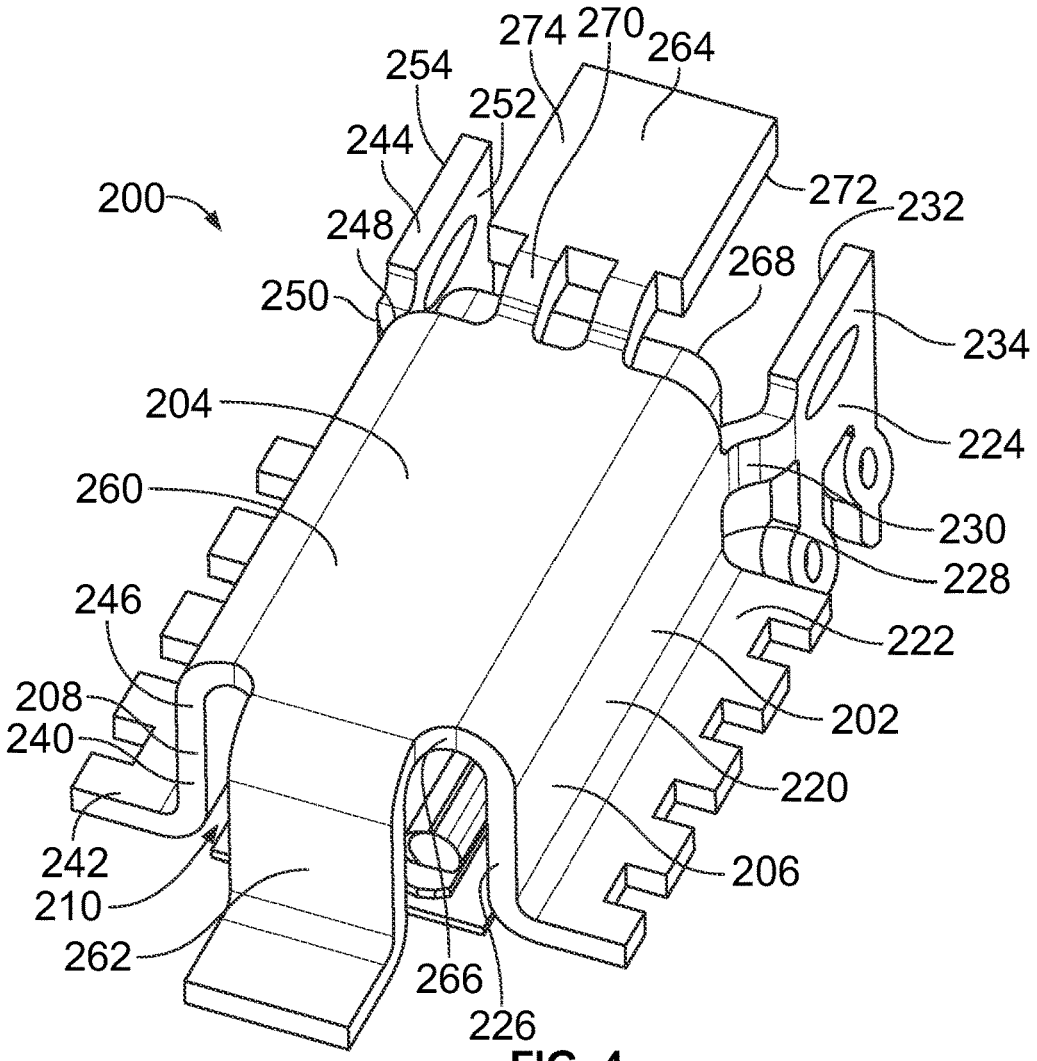
FIG. 4 is a front perspective view of the ground shield in accordance with an exemplary embodiment.

FIG. 4 is a front perspective view of the ground shield 200 in accordance with an exemplary embodiment. The ground shield 200 includes a conductive body 202 that forms an electrical conductor between the cable 104 and the circuit card 106 (both shown in FIG. 2). In various embodiments, the conductive body 202 is a stamped and formed body, which may be stamped from a metal plate and then formed into a particular shape. In other various embodiments, the conductive body 202 may be die cast or a plated plastic part.

The ground shield 200 includes an end wall 204, a first side wall 206 extending from a first side of the end wall 204 and a second side wall 208 extending from a second side of the end wall 204. The end wall 204 and the side walls 206, 208 form a cable cavity 210 that receives the cable 104. The end wall 204 and the side walls 206, 208 provide electrical shielding around the cable cavity 210. The end wall 204 extends generally horizontally between the side walls 206, 208, while the side walls 206, 208 extend generally vertically from the end wall 204 to the circuit card 106. The sides of the end wall 204 may be curved at the corners to transition to the first and second side walls 206, 208. In a first orientation, the end wall 204 is a top wall that extends across a top of the cable 104, while the side walls 206, 208 extend downwardly along sides of the cables 104 to interface with the circuit card 106. In a second orientation, the end wall 204 is a bottom wall that extends across a bottom of the cable 104, while the side walls 206, 208 extend upwardly along the sides of the cables 104 to interface with the circuit card 106. Other orientations are possible in alternative embodiments.

The first side wall 206 includes a panel 220, a contact element 222 extending from the panel 220, and a side wall mating tab 224 extending from the panel 220. The side wall mating tab 224 is configured to be terminated to the cable 104. The contact element 222 is configured to be terminated to the circuit card 106. In the illustrated embodiment, the first side wall 206 is L-shaped with the contact element 222 being oriented generally perpendicular relative to the panel 220. The contact element 222 may be soldered to the circuit card 106 in various embodiments. In other embodiments, the contact element 222 may include compliant pins, such as eye-of-the-needle pins, configured to be press-fit into vias of the circuit card 106. The panel 220 extends between a front edge 226 and a rear edge 228 opposite the front edge 226. Optionally, the contact element 222 may extend the entire length between the front and rear edges 226, 228.

In an exemplary embodiment, the side wall mating tab 224 extends rearward from the rear edge 228. The side wall mating tab 224 includes a connecting arm 230 between the side wall mating tab 224 and the panel 220. The arm 230 may be angled outward such that the side wall mating tab 224 is located outside of the plane of the panel 220. For example, the side wall mating tab 224 is flared outward relative to the panel 220. An interior surface 232 of the side wall mating tab 224 is configured to face the cable 104 and is configured to be electrically connected to the cable shield 136 of the cable 104, such as being soldered to the cable shield 136 of the cable 104. The side wall mating tab 224 may be curved to follow a curvature of the cable 104. In an exemplary embodiment, the side wall mating tab 224 includes a connecting portion 234 configured to be connected to the circuit card 106. For example, the connecting portion 234 may include a tail or pin that may be connected to the circuit card 106. In various embodiments, the connecting portion 234 is a compliant pin, such as an eye-of-the-needle pin. In other embodiments, the connecting portion 234 may be a solder tail configured to be soldered to the circuit card 106. Optionally, multiple connecting portions 234 may be provided along the inner edge of the side wall mating tab 224.

The second side wall 208 includes a panel 240, a contact element 242 extending from the panel 240, and a side wall mating tab 244 extending from the panel 240. The side wall mating tab 244 is configured to be terminated to the cable 104. The contact element 242 is configured to be terminated to the circuit card 106. In the illustrated embodiment, the second side wall 208 is L-shaped with the contact element 242 being oriented generally perpendicular relative to the panel 240. The contact element 242 may be soldered to the circuit card 106 in various embodiments. In other embodiments, the contact element 242 may include compliant pins, such as eye-of-the-needle pins, configured to be press-fit into vias of the circuit card 106. The panel 240 extends between a front edge 246 and a rear edge 248 opposite the front edge 246. Optionally, the contact element 242 may extend the entire length between the front and rear edges 246, 248.

In an exemplary embodiment, the side wall mating tab 244 extends rearward from the rear edge 248. The side wall mating tab 244 includes a connecting arm 250 between the side wall mating tab 244 and the panel 240. The arm 250 may be angled outward such that the side wall mating tab 244 is located outside of the plane of the panel 240. For example, the side wall mating tab 244 is flared outward relative to the panel 240. An interior surface 252 of the side wall mating tab 244 is configured to face the cable 104 and is configured to be electrically connected to the cable shield 136 of the cable 104, such as being soldered to the cable shield 136 of the cable 104. The side wall mating tab 244 may be curved to follow a curvature of the cable 104. In an exemplary embodiment, the side wall mating tab 244 includes a connecting portion 254 configured to be connected to the circuit card 106. For example, the connecting portion 254 may include a tail or pin that may be connected to the circuit card 106. In various embodiments, the connecting portion 254 is a compliant pin, such as an eye-of-the-needle pin. In other embodiments, the connecting portion 254 may be a solder tail configured to be soldered to the circuit card 106. Optionally, multiple connecting portions 254 may be provided along the inner edge of the side wall mating tab 244.

The end wall 204 includes a panel 260, a contact element 262 extending from the panel 260, and an end wall mating tab 264 extending from the panel 260. The end wall mating tab 264 is configured to be terminated to the cable 104. The contact element 262 is configured to be terminated to the circuit card 106. In the illustrated embodiment, the contact element 262 is L-shaped having the end of the contact element 262 mounted to the circuit card 106. The contact element 262 may be soldered to the circuit card 106 in various embodiments. In other embodiments, the contact element 262 may include compliant pins, such as eye-of-the-needle pins, configured to be press-fit into vias of the circuit card 106. The panel 260 extends between a front edge 266 and a rear edge 268 opposite the front edge 266. Optionally, the contact element 262 may extend from the front edge 266. The contact element 262 may cover the front end of the cable cavity 210, such as to substantially close off the opening at the front end of the cable cavity 210. The contact element 262 provides electrical shielding for the cable cavity 210.

In an exemplary embodiment, the end wall mating tab 264 extends rearward from the rear edge 268. The end wall mating tab 264 includes one or more connecting arms 270 between the end wall mating tab 264 and the panel 260. The arms 270 may be angled outward such that the end wall mating tab 264 is located outside of the plane of the panel 260. For example, the arms 270 may be bent upward to position the end wall mating tab 264 above the panel 260. An interior surface 272 of the end wall mating tab 264 is configured to face the cable 104 and is configured to be electrically connected to the cable shield 136 of the cable 104, such as being soldered to the cable shield 136 of the cable 104. The end wall mating tab 264 may be curved to follow a curvature of the cable 104.

Figure 5:
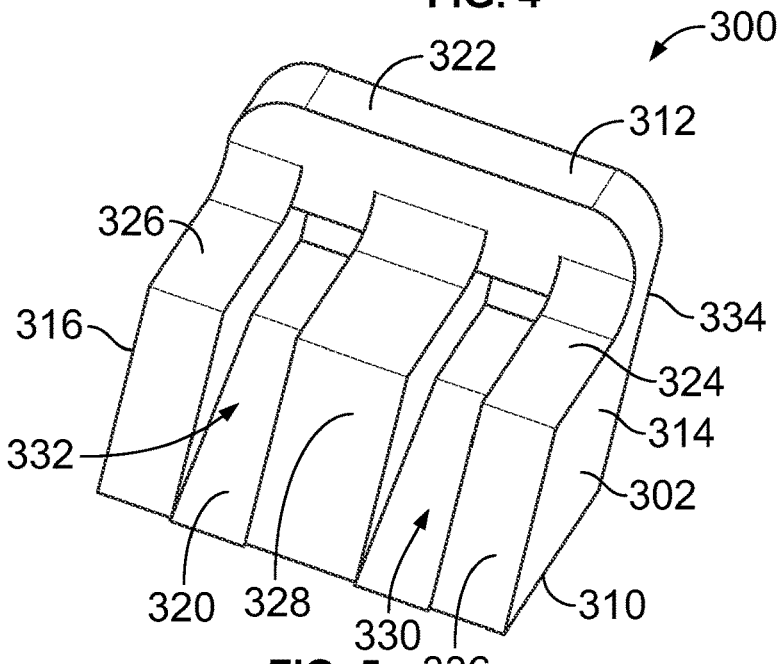
FIG. 5 is a front perspective view of the conductor holder in accordance with an exemplary embodiment.

FIG. 5 is a front perspective view of the conductor holder 300 in accordance with an exemplary embodiment. The conductor holder 300 includes a dielectric body 302 manufactured from a dielectric material. The conductor holder 300 may be molded from a plastic material, such as a liquid crystal polymer material, a nylon material, or another plastic material, in various embodiments.

The conductor holder 300 extends between an inner end 310 and an outer end 312. The conductor holder 300 includes a first side 314 and a second side 316. The conductor holder 300 includes a base 320 at the inner end 310. The base 320 is configured to face the circuit card 106 and may be mounted to the circuit card 106. The conductor holder 300 includes a cap 322 at the outer end 312. The conductor holder 300 includes first and second outer walls 324, 326 extending from the base 320 along the first and second sides 314, 216. The conductor holder 300 includes an inner wall 328 extending from the base 320. The inner wall 328 is located between the outer walls 324, 326.

In an exemplary embodiment, the conductor holder 300 includes conductor channels 330, 332 configured to receive the terminating ends 131, 133 of the signal conductors 130, 132. The conductor channels 330, 332 are located between the outer walls 324, 326 and the inner wall 328. The base 320 is located along inner portions of the conductor channels 330, 332. Optionally, the base 320 may be angled from front-to-rear. For example, the base 320 may be thicker at a rear 334 and thinner at a front 336. For example, the base 320 may be wedge shaped. In an exemplary embodiment, the conductor channels 330, 332 are open at the rear 334 to receive the signal conductors 130, 132. The cap 322 may be located at the rear 334 (at the outer end 312) and extend along and close the conductor channels 330, 332. For example, the cap 322 may extend from the first outer wall 324 to the second outer wall 326 and cover the inner wall 328. In the illustrated embodiment, the cap 322 may be shorter than the base 320 such that the conductor channels 330, 332 are open along the outer end 312 at the front 336.

Figure 6:
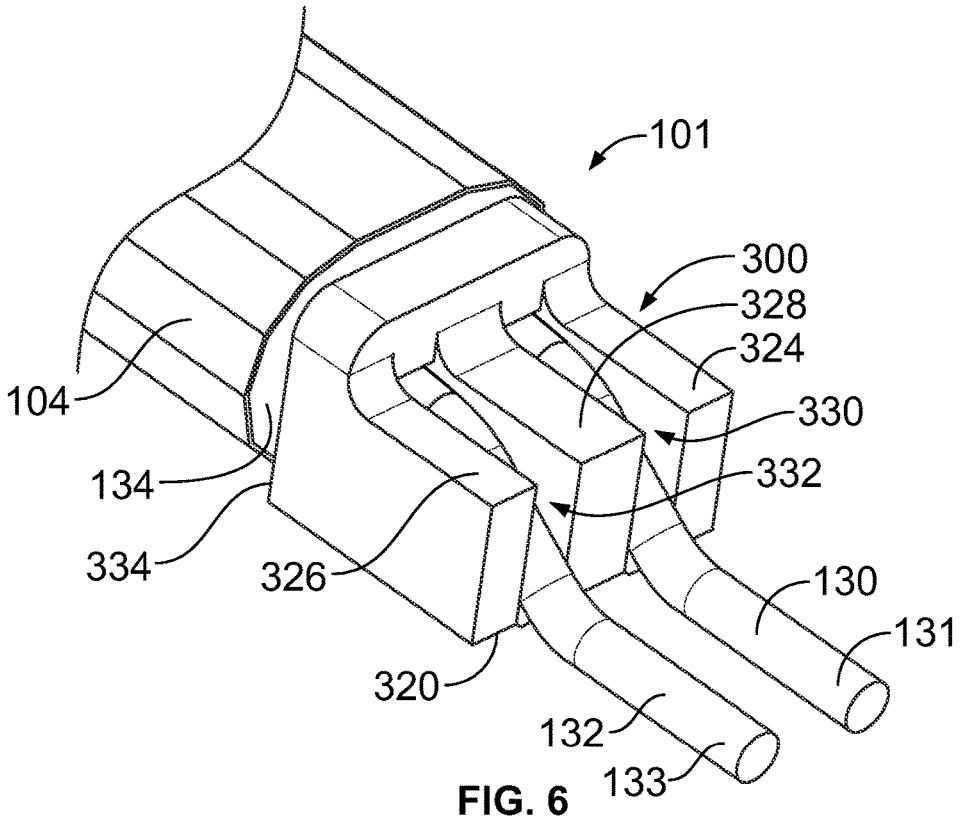
FIG. 6 is a front perspective view of a portion of the cable assembly in accordance with an exemplary embodiment showing the cable coupled to the conductor holder.
Figure 7:
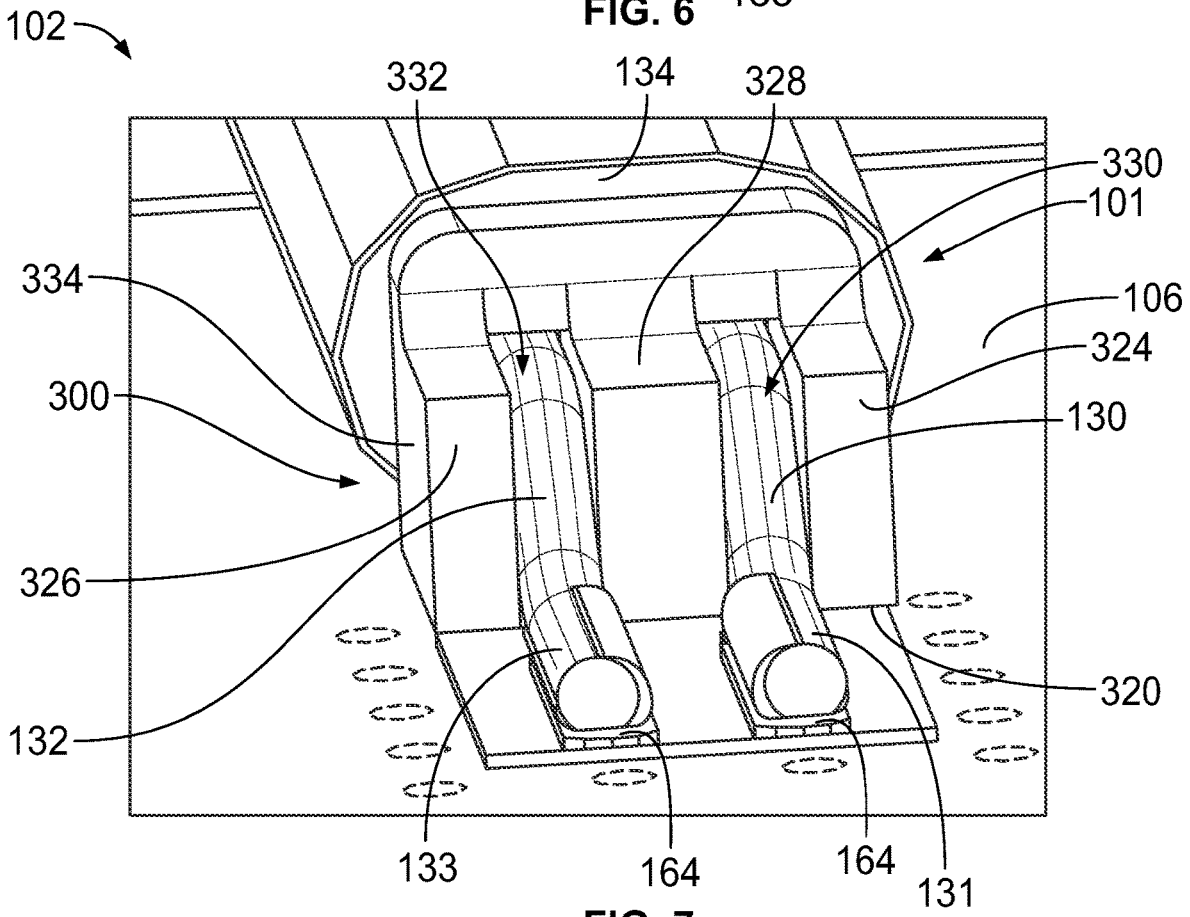
FIG. 7 is a front perspective view of a portion of the cable card assembly in accordance with an exemplary embodiment showing a portion of the cable assembly coupled to the conductor holder.

FIG. 6 is a front perspective view of a portion of the cable assembly 101 in accordance with an exemplary embodiment showing the cable 104 coupled to the conductor holder 300. FIG. 7 is a front perspective view of a portion of the cable card assembly 102 in accordance with an exemplary embodiment showing a portion of the cable assembly 101 coupled to the conductor holder 300. The ground shield 200 (shown in FIG. 8) is not shown in FIGS. 6 and 7 to illustrate the cable 104 and the conductor holder 300.

During assembly, the terminating ends 131, 133 of the signal conductors 130, 132 are loaded into the conductor channels 330, 332 of the conductor holder 300. The conductor holder 300 is pre-formed, such as being a molded part, configured to be coupled to the stripped end of the cable 104. The signal conductors 130, 132 are loaded through the openings at the rear 334 into the conductor channels 330, 332. The signal conductors 130, 132 may be pressed into the conductor channels 330, 332, such as against the base 320. In an exemplary embodiment, widths of the conductor channels 330, 332 may be generally equal to diameters of the signal conductors 130, 132 such that the signal conductors 130, 132 are held in the conductor channels 330, 332 by an interference fit. The conductor holder 300 may include ribs, bumps, or other features that extend into the conductor channels 330, 332 to engage the signal conductors 130, 132 and hold the signal conductors 130, 132 in the conductor channels 330, 332.

The conductor holder 300 controls positioning of the terminating ends 131, 133 of the signal conductors 130, 132 relative to each other. The dimensions of the features of the conductor holder 300 (for example, widths of the walls, conductor channels, and the like) may be tightly controlled during manufacture, such as by tightly controlled molding processes, to repeatably and reliably control positioning of the terminating ends 131, 133 of the signal conductors 130, 132. The material of the conductor holder 300 may be selected to have a certain dielectric constant, such as to control the impedance along the signal paths at the termination zone. The dielectric material of the conductor holder 300 may be a low loss dielectric material, such as a liquid crystal polymer material or a nylon material, selected having a low loss tangent to improve electrical characteristics of the cable assembly 101.

The conductor holder 300 controls positioning of the terminating ends 131, 133 from the end of the insulator 134 to the circuit card 106. The base 320 controls the spacing of the terminating ends 131, 133 relative to the circuit card 106. For example, the thickness of the base 320 may vary from front to rear to change the location of the terminating ends 131, 133 relative to the circuit card 106. The inner wall 328 controls the spacing between the terminating ends 131, 133. For example, a thickness of the inner wall 328 may control the spacing between the terminating ends 131, 133. Optionally, the thickness may vary front-to-rear to control the spacing between the terminating ends 131, 133. In the illustrated embodiment, the spacing between the terminating ends 131, 133 at the end of the insulator 134 may be greater than the spacing of the cable pads 164 such that the spacing transitions and changes from the rear to the front of the conductor holder 300. The outer walls 324, 326 control the spacing between the terminating ends and the ground shield 200. For example, thicknesses of the outer walls 324, 326 may control the spacing between the terminating ends 131, 133 and the ground shield 200.

Figure 8:
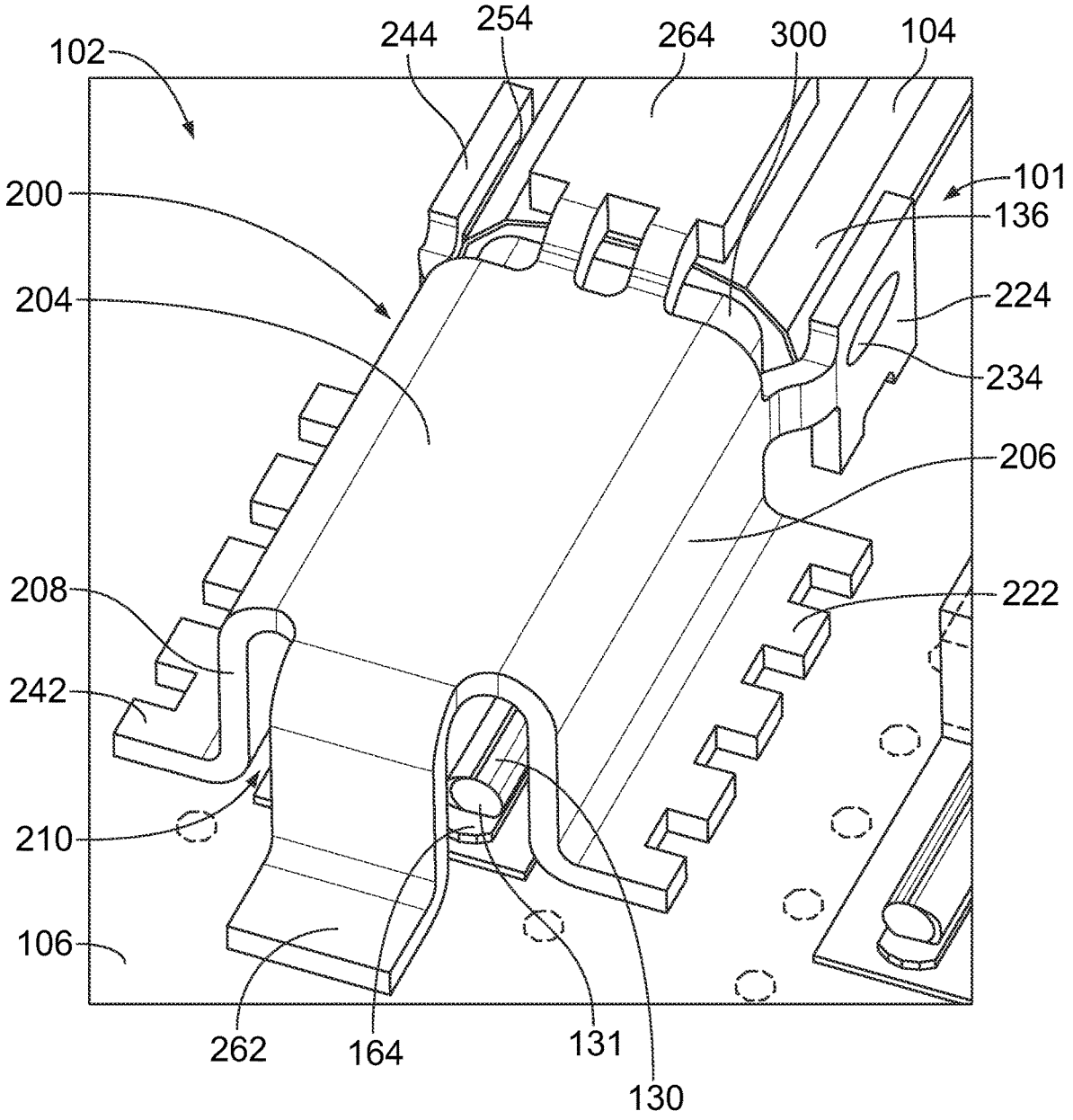
FIG. 8 is a front perspective view of a portion of the cable card assembly in accordance with an exemplary embodiment.

FIG. 8 is a front perspective view of a portion of the cable card assembly 102 in accordance with an exemplary embodiment. The cable card assembly 102 includes the circuit card 106 and the cable assembly 101, including the cable 104, the ground shield 200, and the conductor holder 300. The ground shield 200 and the conductor holder 300 are features of the cable assembly 101 used to improve electrical performance of the cable assembly 101, such as to provide electrical shielding, impedance control, and other features that mitigate loss or signal degradation. The conductor holder 300 positions the signal conductors 130, 132 of the cable 104 relative to each other and relative to the circuit card 106. The conductor holder 300 controls impedance by controlling the dielectric surrounding the signal conductors 130, 132 of the cable 104 in the termination zone to improve electrical performance of the cable card assembly 102. The ground shield 200 provides electrical shielding around the signal conductors 130, 132 at the termination zone with the circuit card 106. The ground shield 200 is electrically connected to the cable shield 136 of the cable 104 and the circuit card 106 to control the ground return paths. The ground shield 200 controls electromagnetic fields in the termination zone to reduce insertion loss and cross talk to improve electrical performance of the cable card assembly 102.

During assembly, after the conductor holder 300 is coupled to the end of the cable 104, the terminating ends 131, 133 of the signal conductors 130, 132 are soldered to the cable pads 164. The ground shield 200 is then coupled to the circuit card 106 and the cable 104. The ground shield 200 surrounds the terminating ends 131, 133 of the signal conductors 130, 132 to provide electrical shielding for the signal paths to reduce insertion loss and cross talk to improve electrical performance of the cable card assembly 102.

During assembly, the end wall 204 and the side walls 206, 208 are coupled to the cable shield 136 of the cable 104. The side wall mating tabs 224, 244 and the end wall mating tab 264 may be soldered to the cable shield 136, such as at the sides and the top of the cable shield 136. The side wall mating tabs 224, 244 and the end wall mating tab 264 define multiple points of contact between the ground shield 200 and the cable shield 136. The side wall mating tabs 224, 244 and the end wall mating tab 264 control the ground return path through the cable assembly 101. In an exemplary embodiment, the side wall mating tabs 224, 244 are terminated directly to the circuit card 106 to control the ground return path through the cable assembly 101, such as using the connecting portions 234, 254.

During assembly, the end wall 204 and the side walls 206, 208 are coupled to the circuit card 106. The contact elements 222, 242, 262 may be soldered to the circuit card 106, such as at the sides and the front of the cable cavity 210. The contact elements 222, 242, 262 define multiple points of contact between the ground shield 200 and the circuit card 106. The contact elements 222, 242, 262 are connected to the circuit card 106 around the perimeter of the cable cavity 210. The contact elements 222, 242, 262 control the ground return path through the cable assembly 101.

Figure 9:
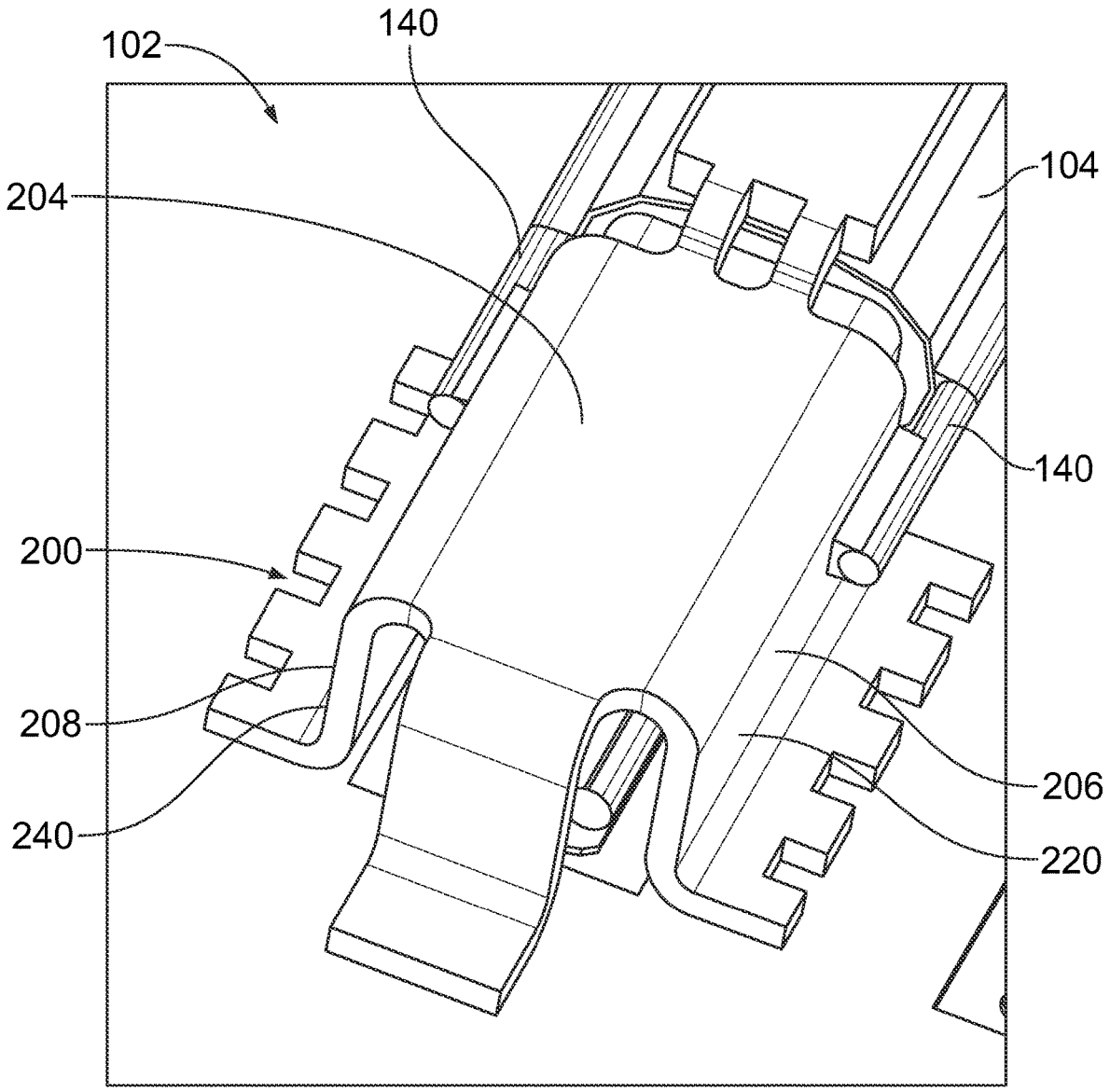
FIG. 9 is a front perspective view of a portion of the cable card assembly in accordance with an exemplary embodiment.

FIG. 9 is a front perspective view of a portion of the cable card assembly 102 in accordance with an exemplary embodiment. In an exemplary embodiment, the cable 104 includes one or more drain wires 140. In the illustrated embodiment, the cable 104 includes two of the drain wires 140 extending along both sides of the cable 104. The drain wires 140 are terminated to the ground shield 200. For example, the drain wires 140 may be soldered to the side walls 206, 208. The drain wires 140 may be terminated directly to the panels 220, 240. The drain wires 140 may additionally or alternatively be terminated to the side wall mating tabs 224, 244 (shown in FIG. 8). The drain wire(s) may additionally, or alternatively, be terminated to the end wall 204.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

What is claimed is:

1. A cable card assembly comprising:

a circuit card having a substrate including an upper surface and a lower surface, the substrate extending between a first end and a second end, the circuit card having mating pads, the circuit card having cable pads, the cable pads being electrically connected to corresponding mating pads, the circuit card having a ground plane;

cables terminated to the circuit card, each cable having signal conductors and an insulator surrounding the signal conductors, terminating ends of the signal conductors exposed forward of an end of the insulator, the cable having a cable shield providing electrical shielding for the at least one signal conductor, the cable shield surrounding the insulator;

conductor holders located forward of ends of the insulators, each conductor holder being manufactured from a dielectric material, each conductor holder having conductor channels that receive the terminating ends of the corresponding signal conductors; and ground shields terminated to the ground plane of the circuit card, the ground shields providing electrical shielding for the corresponding cables, each ground shield including a first side wall, a second side wall and an end wall between the first and second side walls, the first and second side walls extending from the end wall to the circuit card, the end wall having an end wall connecting portion coupled to the cable shield, the first side wall having a first side wall connecting portion coupled to the cable shield, the second side wall having a second side wall connecting portion coupled to the cable shield.

2. The cable card assembly of claim 1, wherein each conductor holder includes a base located between the terminating ends of the signal conductors and the substrate, the base supporting the terminating ends of the signal conductors.

3. The cable card assembly of claim 1, wherein each conductor holder includes outer walls between the terminating ends of the signal conductors and the ground shield to separate the terminating ends from the ground shield and an inner wall between the terminating ends of the signal conductors to separate the terminating ends from each other.

4. The cable card assembly of claim 1, wherein the conductor channels have widths approximately equal to the diameters of the terminating ends of the signal conductors to hold the terminating ends in the conductor channels by an interference fit.

5. The cable card assembly of claim 1, wherein the conductor holders control positioning of the terminating ends from the ends of the insulators to the cable pads.

6. The cable card assembly of claim 1, wherein the first and second side walls extend along first and second outer walls at opposite sides of the conductive holders.

7. The cable card assembly of claim 1, wherein each conductive holder includes a cap covering the conductor channels, the cap located between the end wall and the terminating ends of the signal conductors.

8. The cable card assembly of claim 1, wherein the first and second side wall connecting portions include side wall mating tabs terminated to the circuit card.

9. The cable card assembly of claim 1, wherein the first and second side walls are spaced apart by a first lateral spacing, the first and second side wall connecting portions being spaced apart by a second lateral spacing greater than the first lateral spacing.

10. The cable card assembly of claim 1, wherein the end wall includes an end wall mating tab forward of the conductor holder, the end wall mating tab terminated to the circuit card.

11. The cable card assembly of claim 1, wherein the cable includes first and second drain wires soldered to the exterior surfaces of the first and second side walls.

12. A cable assembly for a circuit card, the cable assembly comprising:

a cable having a first signal conductor, a second signal conductor, and an insulator surrounding the first and second signal conductors, the first and second signal conductors having terminating ends exposed forward of an end of the insulator, the terminating ends configured to be terminated to the circuit card, the cable including a cable shield providing electrical shielding for the first and second signal conductors, the cable shield surrounding the insulator;

a conductor holder located forward of the end of the insulator, the conductor holder being manufactured from a dielectric material, the conductor holder including conductor channels that receive the terminating ends of the first and second signal conductors; and a ground shield configured to be terminated to the circuit card, the ground shield providing electrical shielding for the terminating ends, the ground shield including a first side wall, a second side wall and an end wall between the first and second side walls, the first and second side walls extending from the end wall, the end wall having an end wall connecting portion coupled to the cable shield, the first side wall having a first side wall connecting portion coupled to the cable shield, the second side wall having a second side wall connecting portion coupled to the cable shield.

13. The cable assembly of claim 12, wherein each conductor holder includes a base located between the terminating ends and the substrate, the base supporting the terminating ends, the conductor holder including outer walls extending from the base and an inner wall extending from the base, the conductor channels defined between the inner wall and the outer walls, the outer walls located between the terminating ends and the ground shield to separate the terminating ends from the ground shield, the inner wall located between the terminating ends to separate the terminating ends from each other.

14. The cable assembly of claim 12, wherein the conductor holders control positioning of the terminating ends from the ends of the insulators to the cable pads.

15. The cable assembly of claim 12, wherein the first and second side walls extend along first and second outer walls at opposite sides of the conductive holders.

16. The cable assembly of claim 12, wherein the first and second side wall connecting portions include side wall mating tabs terminated to the circuit card.

17. An electrical connector comprising:

a connector housing having a mating end configured to be coupled to a mating electrical connector, the connector housing having a housing cavity; and a cable card assembly received in the housing cavity, the cable card assembly including a circuit card and cables terminated to the circuit card, the cable card assembly including conductor holders associated with the cables, t cable card assembly including ground shields associated with the cables and terminated to the circuit card to provide electrical shielding for the cables;

wherein the circuit card includes a substrate including an upper surface and a lower surface, the substrate extending between a first end and a second end, the circuit card having mating pads configured to be mated with the mating electrical connector, the circuit card having cable pads, the cable pads being electrically connected to corresponding mating pads, the circuit card having a ground plane;

wherein the cables are terminated to the circuit card, each cable having signal conductors and an insulator surrounding the signal conductors, terminating ends of the signal conductors exposed forward of an end of the insulator, the cable having a cable shield providing electrical shielding for the at least one signal conductor, the cable shield surrounding the insulator;

wherein the conductor holders are located forward of the ends of the insulators, each conductor holder being manufactured from a dielectric material, each conductor holder having conductor channels that receive the terminating ends of the corresponding signal conductors; and wherein ground shields are terminated to the ground plane of the circuit card, the ground shields providing electrical shielding for the corresponding cables, each ground shield including a first side wall, a second side wall and an end wall between the first and second side walls, the first and second side walls extending from the end wall to the circuit card, the end wall having an end wall connecting portion coupled to the cable shield, the first side wall having a first side wall connecting portion coupled to the cable shield, the second side wall having a second side wall connecting portion coupled to the cable shield.

18. The electrical connector of claim 17, wherein each conductor holder includes a base located between the terminating ends and the substrate, the base supporting the terminating ends, the conductor holder including outer walls extending from the base and an inner wall extending from the base, the conductor channels defined between the inner wall and the outer walls, the outer walls located between the terminating ends and the ground shield to separate the terminating ends from the ground shield, the inner wall located between the terminating ends to separate the terminating ends from each other.

19. The electrical connector of claim 17, wherein the conductor holders control positioning of the terminating ends from the ends of the insulators to the cable pads.

20. The electrical connector of claim 17, wherein the first and second side wall connecting portions include side wall mating tabs terminated to the circuit card.

* * * * *